US005655997A

United States Patent [19]

Greenberg et al.

[11] Patent Number: 5,655,997

[45] Date of Patent: Aug. 12, 1997

[54] FITNESS FEEDBACK SYSTEM FOR WEIGHT STACK MACHINES

[75] Inventors: Andrew D. Greenberg; Keith E. Camhi, both of Stamford, Conn.

[73] Assignee: Integrated Fitness Corporation, Stamford, Conn.

[21] Appl. No.: 271,183

[22] Filed: Jul. 7, 1994

[51] Int. Cl.[6] ..... A63B 21/005

[52] U.S. Cl. ..... 482/5; 482/1; 482/4; 482/93; 482/900

[58] Field of Search ..... 482/1–9, 900–902, 482/92, 93; 73/379.01–379.03, 379.09

[56] References Cited

U.S. PATENT DOCUMENTS

| | | | |
|---|---|---|---|
| 3,675,640 | 7/1972 | Gatts . | |
| 4,063,726 | 12/1977 | Wilson . | |
| 4,099,713 | 7/1978 | Spector . | |
| 4,112,928 | 9/1978 | Putsch . | |
| 4,360,345 | 11/1982 | Hon . | |
| 4,493,485 | 1/1985 | Jones . | |
| 4,542,897 | 9/1985 | Melton . | |
| 4,544,154 | 10/1985 | Ariel . | |
| 4,556,216 | 12/1985 | Pitkanen . | |
| 4,566,692 | 1/1986 | Brentham . | |
| 4,569,518 | 2/1986 | Fulks . | |
| 4,601,468 | 7/1986 | Bond . | |
| 4,628,910 | 12/1986 | Krukowski . | |
| 4,746,113 | 5/1988 | Kissel | 272/118 |
| 4,765,613 | 8/1988 | Voris . | |
| 4,779,865 | 10/1988 | Lieberman . | |
| 4,817,940 | 4/1989 | Shaw . | |
| 4,828,257 | 5/1989 | Dyer . | |
| 4,831,242 | 5/1989 | Englehardt . | |
| 4,865,315 | 9/1989 | Paterson . | |
| 4,869,497 | 9/1989 | Stewart . | |
| 4,907,795 | 3/1990 | Shaw . | |
| 4,919,418 | 4/1990 | Miller | 482/901 X |
| 5,020,794 | 6/1991 | Englehardt . | |
| 5,037,089 | 8/1991 | Spagnuolo . | |
| 5,054,774 | 10/1991 | Belsito . | |
| 5,062,632 | 11/1991 | Dalebout et al. . | |
| 5,089,960 | 2/1992 | Sweeney . | |
| 5,117,170 | 5/1992 | Keane . | |
| 5,213,555 | 5/1993 | Hood et al. | 482/57 |
| 5,275,045 | 1/1994 | Johnston et al. | 73/379.01 |
| 5,314,394 | 5/1994 | Ronan | 482/104 |
| 5,331,851 | 7/1994 | Parviainen et al. | 482/902 X |

FOREIGN PATENT DOCUMENTS

| | | |
|---|---|---|
| 0095832 | 12/1983 | European Pat. Off. . |
| 015299A1 | 8/1985 | European Pat. Off. . |
| 0 445 617 | 9/1991 | European Pat. Off. . |
| 2045215 | 2/1971 | France . |
| 230504 | 1/1911 | Germany . |
| 38 07 038 C1 | 9/1989 | Germany . |
| 38 14 559 | 11/1989 | Germany . |
| 93 07 657 | 10/1993 | Germany . |
| 2016934 | 9/1979 | United Kingdom . |
| 2 057 275 | 4/1981 | United Kingdom . |
| 2094647 | 9/1982 | United Kingdom . |
| 2157578 | 10/1985 | United Kingdom . |

*Primary Examiner*—Jerome Donnolly
*Assistant Examiner*—Glenn E. Richman
*Attorney, Agent, or Firm*—Cummings & Lockwood

[57] ABSTRACT

An apparatus for providing feedback to a user of a weight stack machine having weights for lifting has an enclosure adapted for attachment to the weight stack machine. Means for sensing weight for determining the number of weights lifted is provided as well as encoder means for detecting the motion of the weights during a lift. Electronic detection means are operatively coupled to the weight sensors means and the encoder means for computing data describing the number of weights lifted. Interface means for transmitting the computed data from the electronic detection means to a central storage means and the display is provided. The interface means also receives information from the central storage means and displays it on the display.

21 Claims, 2 Drawing Sheets

FITNESS FEEDBACK SYSTEM FOR WEIGHT STACK MACHINES

BACKGROUND OF THE INVENTION

1. Field of Invention

This invention relates generally to improvements in the monitoring, tracking, recording, updating and feedback of physical exercise related information based on sensing of weight stack elements in physical conditioning devices and exercise systems.

2. The Prior Art

Exercise programs for the development, maintenance or rehabilitation of human muscles through exercise have been long in use. One element of an exercise and rehabilitation program involves the use of fitness machines to impose varying loads on human muscles to stimulate them towards further development or rehabilitation.

Many different types of fitness machines are known. They differ depending on the means for providing the required varying loads on human muscles. The load varying function is performed in the prior art by machines comprising such resistance devices as springs and, more popularly, pulleys and weights. Among the machines using pulleys and weights, weight stack based fitness machines are well known. They provide resistance to motion of various human muscles by using the force of gravity as reflected in the weight stack. The amount of force chosen by the user for exercise purposes is determined by the number of weight plates selected from the weight stack. Typically the selection of the weight to be used for exercise purposes is made by inserting an engagement pin determinative of the number of weight plates to be lifted.

While weight stack machines are popular because of their ease of use, good biomechanics, and wide availability, they are limited in that feedback information required to optimize an exercise regimen is not conveniently available at or in the proximity of the machine from one exercise session to another. Feedback information about progress during a multi-session exercise program is generally desirable as it facilitates the use of the fitness machine by helping to insure correct, safe form, improving staff interaction, and making the activity psychologically rewarding. As this level of psychological reward is increased, so is the likelihood of continued utilization of the machine. The feedback required to assure a safe, psychologically satisfying, and physically useful exercise typically consists of tracking of aggregate weight lifting progress, monitoring of the full range of motion, monitoring lifting at the proper rate, increasing weight based on previous weight lifting success, exercising various muscle groups in an instructor determined order, and providing machine settings for each individual user.

Conversely, lack of feedback hampers the efficient performance of a long term exercise regimen. Currently, the general means for generating feedback to the user is by forcing on the user the arduous accounting task of manual data entry and subsequent recall of weight machine settings and weight progression sequences necessary for optimum physical development. Performing this accounting task, or avoiding it completely, increases the frustration and decreases the rewards associated with using a fitness machine and therefore impedes the motivation for continuing a beneficial physical exercise program.

Yet another limitation of the present manual feedback system is that manually generated records do not lend themselves readily to creating graphs depicting historical data in an easy to comprehend format nor reports to inform the user of his progress, nor can incentives be conveniently built into a manual feedback system.

It is therefore an object of this invention to simplify or eliminate the accounting task generally associated with a physical exercise program conducted on weight stack machines.

It is another object of the present invention to provide a means for sensing and displaying individual exercise related parameters such as, for example, weight, weight range of motion, rate of lift, and number of weight lift repetitions, that can be retrofit or originally installed on exercise equipment using weight stacks.

Yet another object of the present invention is to capture and report exercise related parameters to a central location for storage and subsequent feedback to the user or physical exercise professional.

It is another object of the present invention to provide a display in the proximity of a weight stack machine to timely inform the user of the specifically optimized personal settings of the machine, such as seat settings, number of repetitions, number of sets, and number of weights to be used for an exercise program tailored to a particular individual as well as other related exercise data.

These together with other objects and advantages of the invention which will be subsequently apparent reside in the details of construction and operation as more fully hereinafter described and claimed, reference being had to the accompanying drawings forming a part thereof, wherein like numerals refer to like parts throughout.

BRIEF SUMMARY OF THE INVENTION

An apparatus for providing feedback to a user of a weight stack machine having weights for lifting is described. The apparatus comprises an enclosure adapted for attachment to, inclusion in, or placement proximate to the weight stack machine as well as a display mounted in the vicinity of the weight stack machine. Means for sensing the number of weight plates lifted to determine the amount of weight lifted is provided as well as encoder means for detecting the distance of the weight during a lift.

Electronic detection means are operatively coupled to the weight sensors means and the encoder means for computing data describing amount of weight lifted and distance and velocity of motion of the weight. In addition, interface means for transmitting the computed data from the electronic detection means to a central storage and reporting means and the display is provided. The interface means also receives information from the central storage means and displays it on the display.

The encoder means comprises a retractable cable assembly having a first and a second end. The first end is anchored to the enclosure and the second end is adapted for attachment to the weight stack machine. The cable is extendable from the enclosure and will retract within the enclosure. The encoder means further comprises a rotary pulse generator coupled to a cable assembly. The pulse output from the encoder means is translated by electronic means to be representative of a distance traveled by said retractable cable.

The weight sensor means comprises either a plurality of proximity sensors such as, for example, photo sensitive or inductive pickup sensors, one or more load cells or a light curtain.

DETAILED DESCRIPTION OF THE PREFERRED EMBODIMENT

The invention is best understood by reference to the figures wherein all like parts are designated with like numerals throughout.

Figure 1:
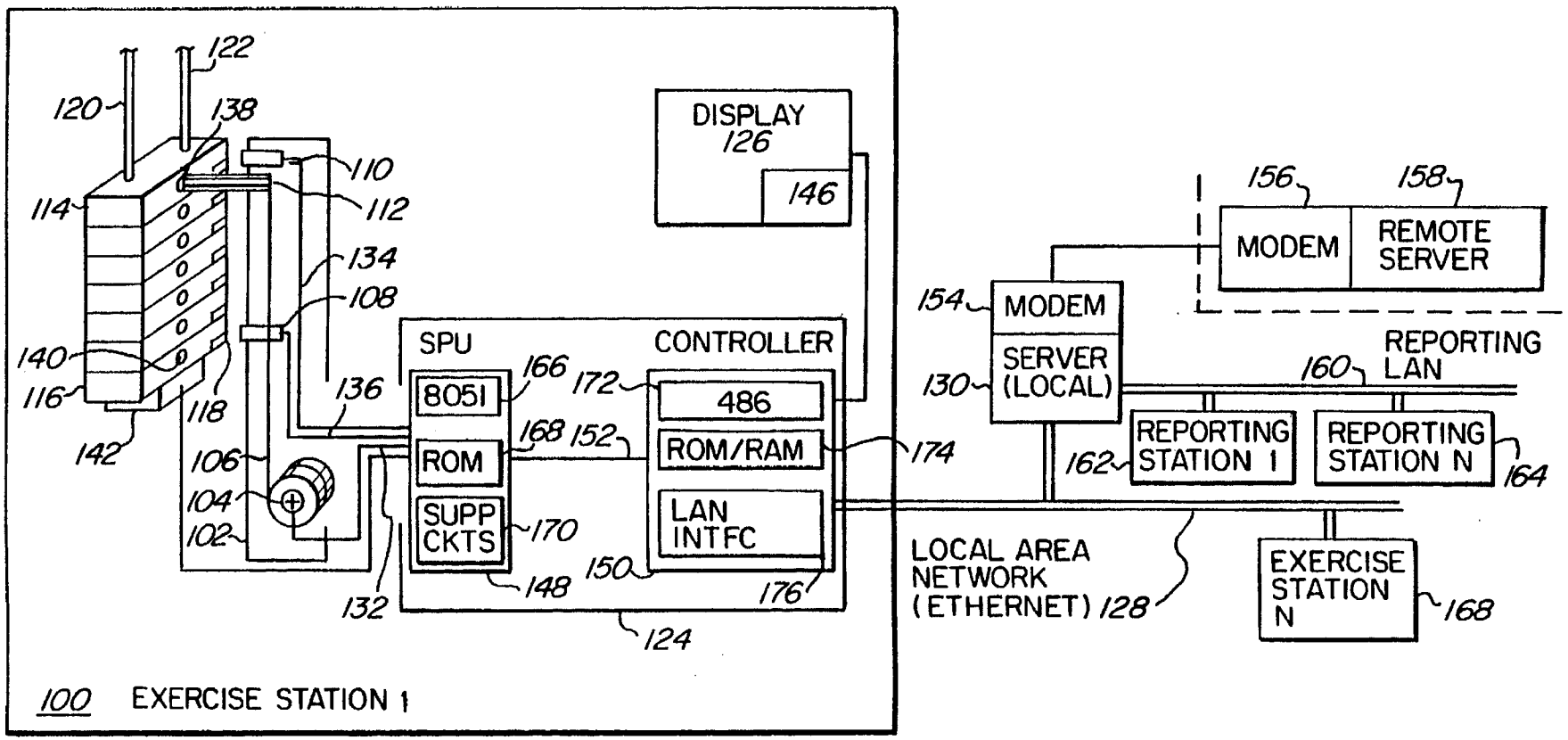
FIG. 1 is a schematic descriptive of an example of the preferred embodiment of the invention.

In FIG. 1, exercise station 100 comprises enclosure 102. Enclosure 102 is adapted to attach mechanically to, or be incorporated in, or stand proximate to a pre-existing or new weight stack machine in proximity to exemplary weights such as 114 and 116 forming a weight stack. Weights 114 and 116 typically slide up and down on guides 120 and 122 while lifted by human muscles during an exercise session. The levers, cables and pulleys used to lift weights 114 and 116 with human muscles are not shown.

One end of cable 106 is attached to weight 114 with pin 112. Pin 112 fits in or next to the hole typically reserved for engaging weight 114 to the means for lifting weight 114 during an exercise session by the user as further detailed in FIG. 2. The other end of cable 106 is wound on the outer surface of a drum mechanically connected to encoder 104. Encoder 104 has an internal spring (not shown) that tensions cable 106 tautly against the anchor point, pin 112, on weight 114. The internal spring of encoder 104 allows sufficient travel for cable 106 to insure that it is fully extended when the weight stack is lifted to its maximum height. Thus, a retractable cable assembly is formed by encoder 104, its internal spring and cable 106. The amount of spring tension applied to cable 106 by the internal spring in encoder 104 is relatively small as compared to weight 114, thus the amount of effort needed to pull cable 106 and rotate the shaft of encoder 104 is minimal.

Encoder 104 converts the linear motion of cable 106 into electrical pulses output on cable 132. Cable 132 conducts pulses from encoder 104 to assembly 124 as well as providing whatever low voltage power may be required by encoder 104 for its operation. The rotation encoding portion of encoder 104 is, for example, a two phase device, where one phase is in quadrature (90 degrees displaced) from the other. This function is performed by part number 610-EM-128-CBL manufactured by Clarostat, of Dover, N.H. In the alternative, as another example, the rotation encoding portion of encoder 104 is a multi-turn absolute encoder with a resolution of 4096 pulses per turn using a 21 bit gray code, having a synchronous serial interface, as manufactured by Lucas Ledex of Vandalia, Ohio. Yet another example of an encoder that may be used for the rotation encoding portion of this invention is part number 800N-00S-0-1, manufactured by Oak Grisby, Sugar Grove, Ill.

Other type of encoders for converting the rotation induced by cable 106 into electronic compatible format that can be used with this invention are multi-turn potentiometers. In this case, the motion of cable 106 connected to exemplary weight plates 114 and 116 will change the angular position and therefore resistance of the multi-turn potentiometer. The changing value of the resistance of the multi-turn potentiometer can be monitored by sensing the voltage across the multi-turn potentiometer with an analog to digital (A/D) converter located in assembly 124. The pulses created by the A/D converter are representative of the rotation of encoder 104 and the motion of cable 106.

Proximity sensors 110 and 108 are vertically aligned with the path of exemplary weights 114 and 116. Reflective labels such as 118, or pieces of reflective tape, or portions of the weight metal itself can be employed to effect sensing. The vertical axis of sensors 110 and 108 is to one side of the central vertical axis of weights 114 and 116 so as to allow cable 106 to move unimpeded in the vertical plane passing through or parallel to exemplary center holes 138 and 140 of weights 114 and 116 respectively. Sensors 108 and 110 are, for example, photo sensitive units detecting the passage of the presence of the weight plates or reflective surfaces. Typical of sensors 108 and 110 is part number S18SN6D manufactured by Banner Engineering Corp, Minneapolis, Minn. Other examples of sensor 108 and 110 is part number XUB-J083135 manufactured by Telemechaniques, Owings Mills, Md. and part number OBT200-18GM70-E0, manufactured by Pepperl and Fuchs, Twinsburgh, Ohio.

As another example, sensors 110 and 108 can be inductive pick up units such as part number NBN10-F10-E0 by Pepperl and Fuchs, Twinsburgh, Ohio. In this case, the change in reluctance from the passage, i.e. presence to absence transition of steel weights, such as 114 and 116, past sensor 108 and/or 110 will output a signal. Alternatively, the proximity sensors can be magnetically activated. The signal from sensor 110 will travel via cable 134 to assembly 124, while signals from sensor 108 are transmitted via cable 136 to assembly 124. The power required by sensors 108 and 110 is transmitted from assembly 124 through cables 136 and 134 respectively.

Yet another example of a proximity sensor to be used in, this invention is a light curtain. In this case, sources of light are placed on one side of the weight stack formed by exemplary weights 114 and 116 and light detectors are placed along the axis formed by sensors 108 and 110, across from the light sources. Motion of weights 114, or 116 will be detected by light being sensed by the light sensors.

Yet another example of the implementation of this invention is to provide a load cell 142 placed Under the weight stack formed by weights such as 114 and 116. The load cell 142 is typically used instead of sensors 110 and 108 to identify the exact amount of weight being lifted. Initially the load cell measures the weight of all weights in the weight stack. After the lift begins, as indicated by motion from a device such as encoder 104, the lifted weight will be given by the difference between the weight reading before the lift and after the lift. Cable 144 connects load cell 142 to assembly 124.

Yet another example of detecting the amount of weight being lifted is to connect cable 106 to a pin used to mechanically engage a certain number of weight plates in a weight stack machine for a particular exercise. In this case, encoder 104 senses the initial position of the pin with respect to a fixed starting position. The extension of cable 106 with respect to its starting position is determinative of the number of plates engaged in the weight stack machine and therefore of the weight being lifted. Subsequent motion of cable 106 is treated as indicative of the lift.

Assembly 124 computes the speed and distance traveled by cable 106, as detected by encoder 104 and the number or height of weights moved as detected by a plurality of sensors, for example 108 and 110. The placement of a plurality of sensors 108 and 110 with respect to the weight stack is critical to achieve this function. The spacing between sensors such as 108 and 110 is shorter than the smallest expected lifting distance for weights, such as 114 and 116. If this condition is not met, when a weight stack is partially lifted for a distance less than the spacing of the sensors, then sensor 110 may not count all the weights lifted as not all the weights lifted have passed its field of view. Therefore, assembly 124 correlates the reading from a plurality of sensors, such as 108 and 110, with the motion detected by encoder 104 so as to correctly determine the amount of weight lifted, the actual distance of the lift as well as the velocity of the weight lifted.

Assembly 124 is made up of two parts. The first part is the Sensor Processing Unit (SPU) 148. SPU 148 contains, for example, an 8051 controller 166, Part No. SC87C51CCK44 from Philips Semiconductor of Sunnyvale, Calif. Controller 166 executes a fixed program stored in read only memory (ROM) 168 and is supported by support circuits 170. The function of SPU 148 is to convert the outputs of a plurality of proximity sensors, such as 108 and 110, load cell 142, if present, and encoder 104 to a digital format compatible with controller 150. Multiconductor serial cable 152 connects SPU 148 to controller 150.

The second part of assembly 124, controller 150 typically comprises a microprocessor 172 such as a type 80386 manufactured by Intel Corporation, Beaverton, Oreg. or a 486 SLC by Cyrix Corporation of Richardson, Tex. The function of controller 150 is to process incoming data made available from SPU 148 and derived from proximity sensors such as 108 and 110, load cell 142 and encoder 104. Another function of controller 150 is to display on display 126 information related to feedback for the user as the exercise session is progressing.

Controller 150 converts data received from SPU 148 into a format compatible with a local area network (LAN) 128, typically an Ethernet as defined by Institutute of Electrical and Electronic Engineers, publication 802.3. LAN interface 176 transforms the data from microprocessor 172 to the protocol required by LAN 128. This function is performed by an Ethernet controller, typically part number MB86965APF-G by Fujitsu Microelectronics Inc., San Jose, Calif.

Pulses from proximity sensors 108 and 110 are converted in SPU 148 and controller 150 in conjunction with information about the motion of cable 106. The SPU 148 receives a pulse from sensors 108 and/or 110 whenever sample weight such as 114 or 116 are no longer sensed, or within the field of view of the proximity sensor. Using the information derived from SPU 148's reading of encoder 104 and motion of cable 106, controller 150 computes how far the weights moved. In effect, the SPU 148 logic receives a pulse indicative of an absence of a weight plate from sensor's 108 or 110 field of view. Receipt of this pulse transfers the "stack height" reading from encoder 104 into a register which the controller 150 uses as a pointer into a table detailing the number of plates as a function of stack height, and therefore, total weight.

An alternative operation of SPU 148 and controller 150 is for SPU 148 to receive a pulse every time a weight plate with reflective surface 118 passes the field of view of proximity sensors such as 108 and 110. The passage of the reflective surface 118 on weights 114 or 116 generates one pulse for each weight plate. The SPU 148 adds or subtracts the number of pulses into a register, in effect counting the number of weight plates being lifted, or total weight. The information required to count up or down is derived from the motion of cable 106 through encoder 104. The controller 150 uses the count in the register as a pointer into a table detailing the total weight as a function of plate count.

Another function of controller 150 is to respond to manual input/output (I/O) section 146 of display 126. This I/O section of display 126 is a touch sensitive screen with software generated icons that activate various exercise related functions when touched by the user. By providing an icon driven system, ease of use is enhanced. The information derived from display I/O section 146 is interpreted by controller 150 to extract the information desired by the user such as, for example, history of previous exercise sessions. This information is displayed on display 126 after being retrieved from server 130, through LAN 128, if not immediately available in controller 150.

On power up of assembly 124, server 130 loads the current software from its mass storage via LAN 128 into the memory section 174 of controller 150 for execution by microprocessor 172. This insures that the most recent software is available to controller 150 on power up. ROM portion of memory section 174 contains specific software routines that enable processor 172 to establish two way communication with server 130 during controller's 150 power up sequence. Controller 150 can also have a means for transferring data from its memory 174 to an external, portable electronically programmable memory or floppy disk, such as part number 3M DSHD 3.5" by 3M Corporation, Data Storage Market Division, St Paul, Minn. Electronically programmable memories are, for example, part number F28F008SA-120 and E28F008SA, manufactured by Intel Corporation, Beaverton, Oreg.

Upon a user logging in at the server, the server 130 computes the necessary exercise information to be used by assembly 124 during the exercise session of the specific user. The information is stored in server 130 waiting for the user to identify his location at an exercise station such as 100 or 168. Upon a second log in at an exercise station such as 100 or 168, assembly 124 of the logged in station accesses server 130 directly to extract the exercise information from the mass storage device in server 130. This procedure transmits the exercise information to assembly 124 of the exercise station where the second log in occurred via network 128.

Server 130 provides to assembly 124 at a specific exercise station such as 100 and 168 the individual seat settings, lift speed, and range of motion parameters associated with the user, Weight lifted at last exercise session and number of repetitions, and target weight and repetitions for this session. Displayed on display 126 upon log in by the user is seat setting, weight lifted at last exercise session and number of repetitions, target weight and repetitions for this session. As the exercise progresses, the weight being lifted, repetition count, range of motion indicator and performance messages are displayed. On completion of the exercise regimen, the data describing weight lifted and repetitions for each set completed is sent as a new file stored in the mass storage device of server 130 via network 128 from assembly 124. This file is subsequently incorporated into the database residing on server 130 for subsequent display and analysis, and in preparation for the next exercise session.

Server 130, connected via LAN 128 to one or more exercise stations such as 100 and 168, is typically located within the same building as the exercise station(s). Within server 130 is a mass storage device, such as a Winchester type hard disk, for example a Seagate Technologies Inc., Scotts Valley, Calif. part number ST-3655A/N capable of storing the information generated by the exercise station(s) such as 100 and 168 for a plurality of users and exercise sessions.

In addition, server 130 is connected via modems 154 and 156 to a remote server 158, allowing exchange of data between local server 130 and remote server 158. Remote server 158 is generally connected to one or more local servers such as server 130 and facilitates the centralization of software distribution to the local servers as well as the collection of exercise data for the users, billing, and other data collection and distribution functions. In general, remote server 158 facilitates storage and backup of end user data, tracking of inter-facility competitions, ability for users to have exercise sessions at any facility connected to server 158, and management of awards related to incentive programs designed to enhance the weight lifting activity.

Server 130 also interfaces with reporting LAN 160. LAN 160 interconnects a plurality of reporting stations 162 or 164 to server 130. Reporting stations 162 and 164 are generally printers and computer based work stations that allow a user of the exercise stations to obtain information about progress of an exercise regimen, enter information about exercises done while not on the system, as well as allow the entry or update of goals by a fitness professional. For example, a user can use a reporting station, such as 162 and 164 to obtain, historical charting, plots and other types of conveniently summarized information from the printer or screen part of the reporting station. In addition, comparisons with population averages and other indexes are provided on request by the user.

Figure 2:
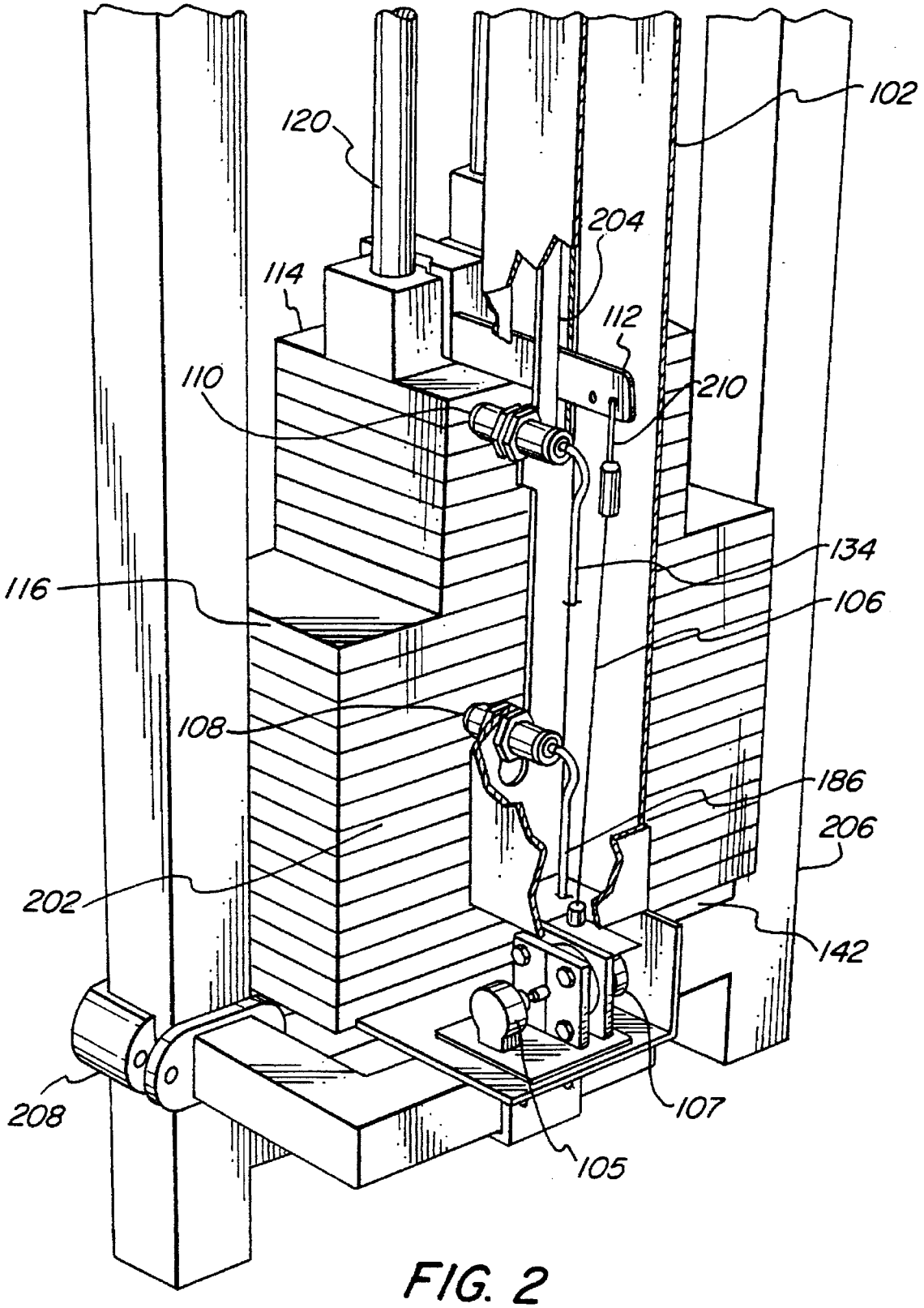
FIG. 2 is a mechanical outline of the various components of the present invention and their spacial relationship as attached to a weight stack machine.

FIG. 2 details the mechanical implementation of the present invention. Sensors 108 and 110 are attached in a slot 202 machined on enclosure 102. Sensors 108 and 110 fit slidingly in groove 202, so that the required plurality of sensors for a particular application can be accommodated in slot 202 at a particular, variable height determined by the range of motion of weight plates of a particular weight station. Encoder 104 of FIG. 1 is made up of retractable cable assembly 107 and rotation encoding portion 105. Retractable cable assembly 107 can be, for example, part number LXEP manufactured by Unimeasure, Corvallis, Oreg. Pin 112 anchors cable 106 to the top weight position and can move in a vertical plane along slot 204. Pin 112 interfaces mechanically with quick release 210 attached to cable 106. Slot 204 is parallel to slot 202 and is also machined in enclosure 102. Bracket 208 attaches to the frame of weight stack machine 206 to support enclosure 102.

The invention may be embodied with equivalent parts performing equivalent functions without departing from its purpose and essential characteristic. Therefore, the described implementation is to be considered only as illustrative of the invention and not restrictive. The scope of the invention is therefore indicated in the claims below to their full legal extent.

We claim:

1. An apparatus for providing feedback to a user of a weight stack machine having a plurality of weight plates for lifting and a frame, said apparatus comprising:

weight sensing means for determining the number of said weight plates lifted;

encoder means for detecting the distance moved by said weight plates during a electronic detection means operatively coupled to said weight sensing means and said encoder means for computing data describing the weight of said weight plates being lifted; and interface means for transmitting said data from said electronic detection means to a storage means.

2. The apparatus of claim 1 wherein said storage means is a display.

3. The apparatus of claim 1 wherein said storage means is a mass storage device.

4. The apparatus of claim 1 wherein said storage means is an electronically programmable memory.

5. The apparatus of claim 1 wherein said encoder means comprises a retractable cable assembly having a first and a second end, said first end anchored to said frame and said second end adapted for attachment to one of said weights.

6. The apparatus of claim 5 wherein said second end is attached to a pin used in said stack machine determinative of the number of said weight plates for lifting.

7. The apparatus of claim 5 wherein said encoder means further comprises a rotary pulse generator coupled to said cable assembly having a pulse output, said pulse output representative of a distance traveled by said retractable cable.

8. The apparatus of claim 5 wherein said encoder means is a multi-turn potentiometer.

9. The apparatus of claim 1 wherein said weight sensor means comprises a plurality of proximity sensors.

10. The apparatus of claim 9 wherein said proximity sensors are photo sensitive.

11. The apparatus of claim 9 wherein said proximity sensors are inductive sensors.

12. The apparatus of claim 9 wherein said proximity sensors are magnetically activated.

13. The apparatus of claim 9 wherein said proximity sensors comprise a light curtain.

14. A method for providing feedback to a user of a weight stack machine having a plurality of weight plates for lifting, said method comprising the steps of:

determining the number of said weight plates lifted;

detecting the distance and speed of said weight plates during a lift;

computing data describing the weight of said weight plates lifted;

transmitting said data to a storage means.

15. A method as described in claim 14 further comprising receiving information from a storage means.

16. A method as described in claim 14 further comprising displaying said data on a display.

17. An apparatus for providing feedback to a user of a weight stack machine having a plurality of weight plates for lifting, said apparatus comprising:

weight sensing means for determining the number of said weight plates lifted;

encoder means for detecting the distance moved by said weight plates during a lift;

electronic detection means operatively coupled to said weight sensing means and said encoder means for computing data describing the weight of said weight plates lifted;

interface means for transmitting said data from said electronic detection means to a central storage means; and reporting means operatively connected to said central storage means for generating reports from said data.

18. The apparatus of claim 17 wherein said interface means receives data from said central storage means.

19. The apparatus of claim 17 wherein said data from said storage means contains programming steps to be executed by said interface.

20. The apparatus of claim 17 wherein said data from said storage means contains historical data associated with a user of said apparatus.

21. The apparatus of claim 20 wherein said data is displayed on a display.

* * * * *

US005655997C1

(12) EX PARTE REEXAMINATION CERTIFICATE (5153rd)

United States Patent
Greenberg et al.

(10) Number: US 5,655,997 C1
(45) Certificate Issued: Jul. 19, 2005

(54) FITNESS FEEDBACK SYSTEM FOR WEIGHT STACK MACHINES

(75) Inventors: Andrew D. Greenberg, Stamford, CT (US); Keith E. Camhi, Stamford, CT (US)

(73) Assignee: Fitlinxx, Inc., Stamford, CT (US)

Reexamination Request:
No. 90/007,023, Apr. 30, 2004

Reexamination Certificate for:

| | |
|---|---|
| Patent No.: | **5,655,997** |
| Issued: | **Aug. 12, 1997** |
| Appl. No.: | **08/271,183** |
| Filed: | **Jul. 7, 1994** |

(51) Int. Cl.[7] ..... A63B 21/005
(52) U.S. Cl. ..... 482/5; 482/1; 482/4; 482/93; 482/900
(58) Field of Search ..... 482/1–9, 900–902, 482/92, 93; 73/379.01–379.03, 379.09

(56) References Cited

FOREIGN PATENT DOCUMENTS

WO WO 87/05727 9/1987

*Primary Examiner*—Stephen R Crow

(57) ABSTRACT

An apparatus for providing feedback to a user of a weight stack machine having weights for lifting has an enclosure adapted for attachment to the weight stack machine. Means for sensing weight for determining the number of weights lifted is provided as well as encoder means for detecting the motion of the weights during a lift. Electronic detection means are operatively coupled to the weight sensors means and the encoder means for computing data describing the number of weights lifted. Interface means for transmitting the computed data from the electronic detection means to a central storage means and the display is provided. The interface means also receives information from the central storage means and displays it on the display.

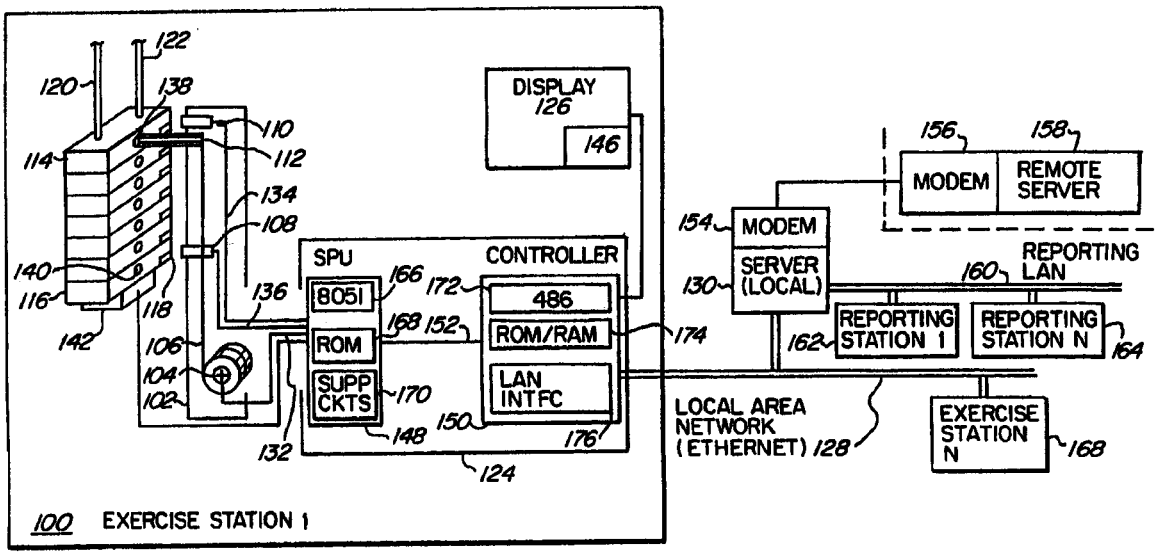

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 14 and 17 are determined to be patentable as amended.

Claims 2–13, 15–16 and 18–21, dependent on an amended claim, are determined to be patentable.

1. An apparatus for providing feedback to a user of a weight stack machine having a plurality of weight plates for lifting and a frame, said apparatus comprising:

weight sensing means for determining the number of said weight plates lifted*, wherein said weight sensing means are in a non-contact position relative to said weight plates*;

encoder means for detecting the distance moved by said weight plates during a electronic detection means operatively coupled to said weight sensing means and said encoder means for computing data describing the weight of said weight plates being lifted; and interface means for transmitting said data from said electronic detection means to a storage means.

14. A method for providing feedback to a user of a weight stack machine having a plurality of weight plates for lifting, said method comprising the steps of:

*providing sensing means that are in a non-contact position relative to said weight plates for* determining the number of said weight plates lifted;

detecting the distance and speed of said weight plates during a lift;

computing data describing the weight of said weight plates lifted; *and* transmitting said data to a storage means.

17. An apparatus for providing feedback to a user of a weight stack machine having a plurality of weight plates for lifting, said apparatus comprising:

weight sensing means for determining the number of said weight plates lifted *wherein said weight sensing means are in a non-contact position relative to said weight plates*;

encoder means for detecting the distance moved by said weight plates during a lift;

electronic detection means operatively coupled to said weight sensing means and said encoder means for computing data describing the weight of said weight plates lifted;

interface means for transmitting said data from said electronic detection means to a central storage means; and reporting means operatively connected to said central storage means for generating reports from said data.

* * * * *